US007048028B2

(12) United States Patent
Wolfe et al.

(10) Patent No.: US 7,048,028 B2
(45) Date of Patent: May 23, 2006

(54) MOUNTING BRACKET AND HEADRAIL ASSEMBLY

(75) Inventors: Chris Wolfe, High Point, NC (US); Patrick Foley, Winston Salem, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 72 days.

(21) Appl. No.: 10/746,527

(22) Filed: Dec. 24, 2003

(65) Prior Publication Data

US 2005/0109902 A1 May 26, 2005

Related U.S. Application Data

(60) Provisional application No. 60/436,279, filed on Dec. 24, 2002.

(51) Int. Cl.
*E06B 9/30* (2006.01)

(52) U.S. Cl. ..... 160/173 R; 160/902; 248/261

(58) Field of Classification Search ..... 248/261, 248/262, 251, 264; 160/173 R, 178.1, 173 V, 160/178.1 V, 902
See application file for complete search history.

(56) References Cited

U.S. PATENT DOCUMENTS

| | | | | |
|---|---|---|---|---|
| 1,356,675 | A | | 10/1920 | Weir |
| 1,553,132 | A | | 9/1925 | Bertrand |
| 1,805,611 | A | | 5/1931 | Burns |
| 1,822,890 | A | | 9/1931 | Heymer |
| 1,845,857 | A | | 2/1932 | Ward |
| 1,917,416 | A | | 7/1933 | Zingg |
| 1,992,148 | A | | 2/1935 | Hammer |
| 2,060,720 | A | | 11/1936 | Beauchamp |
| 2,138,502 | A | | 11/1938 | Nordstrom, Jr. et al. |
| 2,203,372 | A | | 6/1940 | Trammell |
| 2,247,260 | A | | 6/1941 | Stone |
| 2,281,043 | A | | 4/1942 | Nelson |
| 2,367,322 | A | | 1/1945 | Wright et al. |
| 2,674,432 | A | | 4/1954 | Lorentzen |
| 2,698,727 | A | | 1/1955 | Rutledge |
| 2,807,834 | A | | 10/1957 | Blum |
| 2,808,222 | A | | 10/1957 | Wassyng et al. |
| 2,896,902 | A | | 7/1959 | Graber |
| 3,164,354 | A | | 1/1965 | Murdock |
| 3,169,006 | A | | 2/1965 | Lorentzen et al. |
| 3,544,053 | A | * | 12/1970 | Ingalls ..... 248/219.3 |
| 4,079,770 | A | | 3/1978 | Woodle |
| 4,141,525 | A | | 2/1979 | Miller |
| 4,224,974 | A | | 9/1980 | Anderson et al. |
| 4,235,406 | A | | 11/1980 | Vecchiarelli |
| 4,262,728 | A | | 4/1981 | Debs |
| 4,384,605 | A | | 5/1983 | Schaeffer et al. |
| 4,406,435 | A | | 9/1983 | Anderson |
| 4,411,401 | A | | 10/1983 | Anderson |
| 4,425,956 | A | | 1/1984 | Terlecke |
| 4,531,563 | A | | 7/1985 | Nilsson |

(Continued)

*Primary Examiner*—Ramon O Ramirez
(74) *Attorney, Agent, or Firm*—Marshall, Gerstein & Borun LLP

(57) ABSTRACT

A mounting bracket and headrail assembly for supporting an elongated member from which a plurality of valences may be suspended, and a method of using the mounting bracket and headrail assembly. The mounting bracket has a catch and resilient spring clip to securely receive a first leg of the headrail, leaving the second leg of the headrail exposed. The exposed second leg of the headrail obscures the first leg and mounting bracket from view, thereby avoiding the need to provide additional material to obscure unsightly hardware from view.

4 Claims, 3 Drawing Sheets

U.S. PATENT DOCUMENTS 4,607,677 A 8/1986 Comeau
4,802,644 A 2/1989 Oskam
4,827,199 A 5/1989 Kaucic et al.
4,830,081 A 5/1989 Morris
4,840,216 A 6/1989 John
4,848,434 A 7/1989 Morris et al.
4,919,185 A 4/1990 Comeau et al.
4,921,031 A 5/1990 Wagner et al.
4,938,443 A 7/1990 Rowe
4,947,921 A 8/1990 Chun-cheng
4,949,926 A 8/1990 Liu
4,955,419 A 9/1990 Morris
5,058,650 A 10/1991 Morris
5,060,710 A * 10/1991 Haarer ..... 160/178.1 R
5,074,350 A 12/1991 Carter
5,092,387 A 3/1992 King et al.
D325,681 S 4/1992 Gartenmaier
5,109,909 A 5/1992 Hong
5,180,130 A 1/1993 McMichael
5,186,426 A * 2/1993 Wada ..... 248/251
D337,469 S 7/1993 Young et al.
5,230,493 A 7/1993 Luoto
5,353,857 A 10/1994 Anderson
D355,093 S 2/1995 Morris
D355,094 S 2/1995 Josephson
5,472,035 A 12/1995 Biba et al.
5,533,560 A 7/1996 Morris
5,553,649 A 9/1996 Chisaka et al.
5,584,459 A * 12/1996 Meyer ..... 248/251
D385,449 S 10/1997 Morris
5,680,892 A 10/1997 Liu
5,749,405 A 5/1998 Huang
6,039,295 A 3/2000 de Beijer
6,135,188 A 10/2000 Anderson
6,186,457 B1 2/2001 Carter
D439,461 S 3/2001 Brunell
D440,099 S 4/2001 Horsten
D440,100 S 4/2001 Horsten
D440,444 S 4/2001 Sonnenberg et al.
6,293,330 B1 9/2001 Ciuca
6,311,756 B1 11/2001 Anderson et al.
6,619,366 B1 9/2003 Ciuca

* cited by examiner

MOUNTING BRACKET AND HEADRAIL ASSEMBLY

REFERENCE TO RELATED APPLICATIONS

This application is entitled to the benefit of the filing date of U.S. Provisional Application Ser. No. 60/436,279, filed Dec. 24, 2002, for all subject matter commonly disclosed therein.

FIELD OF THE INVENTION

This invention relates generally to hardware for mounting window coverings and, more particularly, to a mounting bracket and headrail that cooperate with one another to support a window covering, such as window blinds, above a window.

BACKGROUND OF THE INVENTION

There have been many approaches to mounting window coverings, specifically Venetian-style window blinds, to the wall and/or ceiling above a window. Popular mounting assemblies for these window blinds include a generally U-shaped headrail secured in some manner to a mounting bracket that mounts to the wall and/or ceiling. While the manner in which the mounting bracket connected to the generally U-shaped headrail differs among different approaches, there is a common thread.

In order to secure the headrail to the mounting bracket, there are always at least two points of contact between the headrail and mounting bracket, with one of the points of contact located either at the end of one of the legs of the generally U-shaped headrail, along that leg of the headrail, or at the base of that leg, and with the other point of contact located either at the end of the opposite leg of the generally U-shaped headrail, along that opposite leg, or at the base of that opposite leg.

Because the mounting bracket engaged at least a portion of both legs of the generally U-shaped headrail, the mounting bracket of such conventional assemblies has to be at least as deep as the distance separating the two legs of the generally U-shaped headrail. In those mounting assemblies in which the mounting bracket engages either the end of, or along, the leg of the headrail located furthest way from the window itself (i.e. the leg of the headrail that would be most visible to any occupants of a room in which the assembly is located), that portion of the mounting bracket is likely to be visible unless obscured by some suitably aesthetic extension of the headrail or by additional material, such as an extra valence strip.

DETAILED DESCRIPTION OF THE PREFERRED EMBODIMENT

Figure 1:
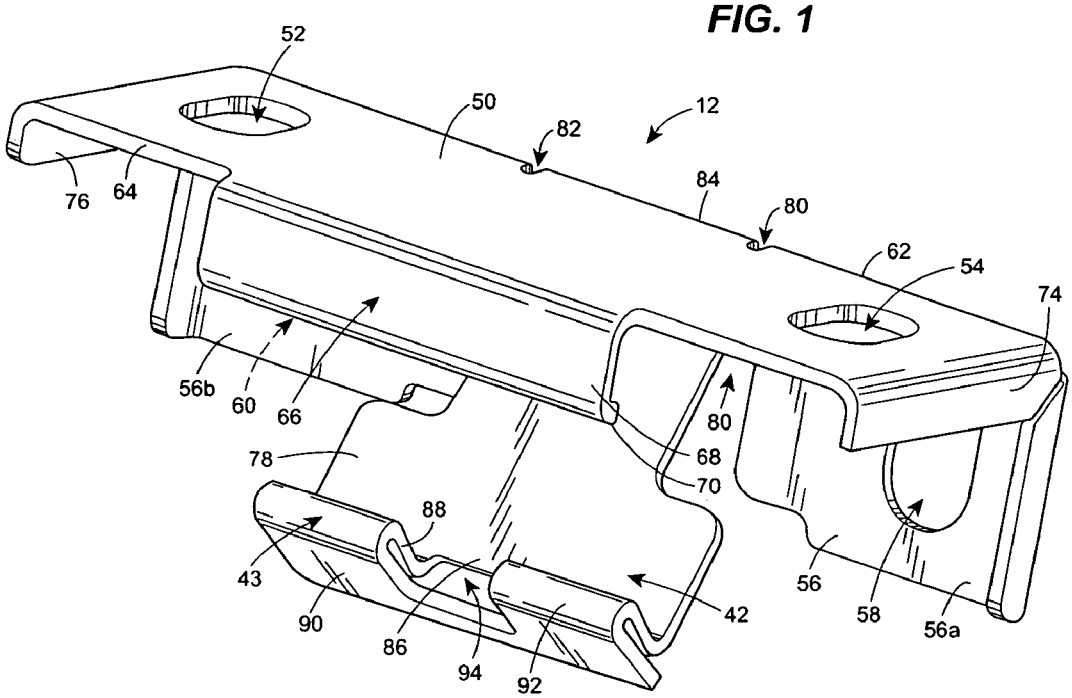
FIG. 1 is a perspective view of a mounting bracket made in accordance with the present invention.
Figure 2:
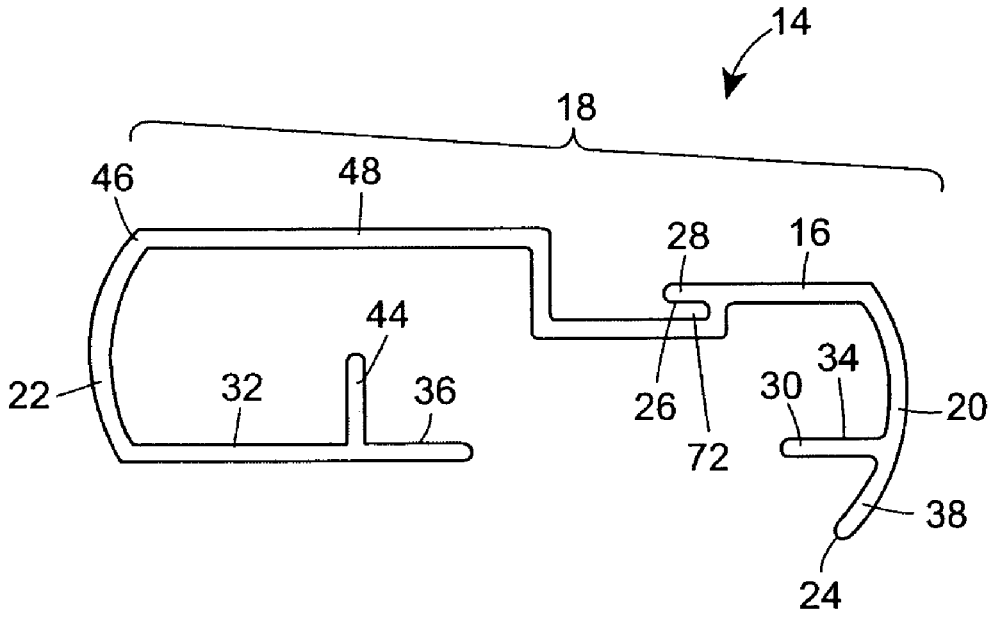
FIG. 2 is an end view of a head rail made in accordance with the present invention.
Figure 3:
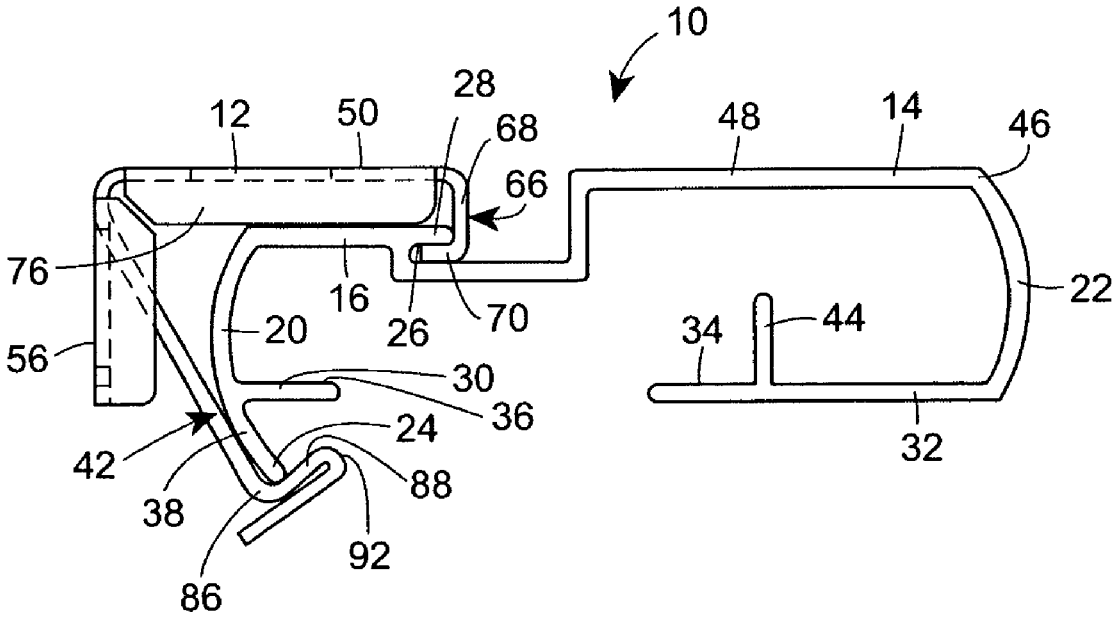
FIG. 3 is an end view taken from the opposite end of that shown in FIG. 2, showing the engagement of the head rail shown in FIG. 2 and the mounting bracket shown in FIG. 1.

The mounting bracket and headrail assembly 10 of the present invention advantageously provides a mounting bracket 12 that engages only one leg of a headrail 14 having a configuration specifically structured to cooperate with the mounting bracket 12. The headrail 14 has an integral shelf 16 provided along the region 18 of the headrail 14 between the two legs 20, 22 of the headrail 14. In addition to engaging an end 24 of one leg 20 of the headrail 14, the mounting bracket 12 engages an undercut 26 provided by an overhanging lip 28 of the shelf 16.

The shelf 16 preferably extends along the entire length of the headrail 14, which facilitates manufacture of the headrail 14 and also facilitates installation. The headrail 14 is preferably made of aluminum. The two legs 20, 22 of the headrail 14 may each advantageously have a curved profile. The legs 20, 22 also include return portions 30, 32, respectively, projecting horizontally toward the opposite leg 22 or 20, preferably extending the entire length of the headrail 14. The return portions 30, 32 are co-planar, and provide ledges 34, 36 to receive an elongated member (not shown) from which a set of valences making up the window blinds depends.

The leg 20 closest to the mounting bracket 12 has an extension 38 extending below the return portion 30. By extending the leg 20 below the return portion 30, a clearance is provided under the return portion 30 such that the end 24 of the leg 20 can be engaged by a spring clip member 42 of the mounting bracket 12, with a hook-like portion 43 at the end of the spring clip member 42 extending over the end 24 of the leg 20.

The width of the headrail 14, i.e. the depth or maximum distance between the legs 20, 22, is preferably significantly greater than the height of the headrail 14. In this manner, the headrail 14 has a short profile while still being of sufficient depth to accommodate the elongated member (not shown) from which the set of valences forming the window blind depends.

The return portion 32 of the leg 22 on the side of the headrail 14 farthest from the mounting bracket 12 may be provided with a vertical wall member 44 to provide a stop that prevents unwanted movement of the elongated member (not shown) received on the ledges 34, 36.

The legs 20, 22 are preferably of approximately equal height to one another, but the shelf 16 in the preferred embodiment is lower than the top end 46 of the leg 22, and thus lower than a top flat panel portion 48 extending between the shelf 16 and the top end 46 of the leg 22. This off-set between the top flat panel portion 48 and the shelf 16 gives the headrail 14 a stepped appearance.

The mounting bracket 12 is preferably made of a suitably strong and resilient material, such as zinc plated 0.032 spring steel, and includes a top plate 50 having fastener-receiving apertures 52, 54 therein for securing the mounting bracket 12 to a horizontal surface, such as a ceiling (not shown), a wall plate 56, also provided with fastener-receiving apertures 58, 60, for securing the mounting bracket 12 to a vertical surface, i.e. a wall (not shown). It is recognized that in lieu of the two fastener-receiving apertures 52, 54 in the top plate 50, which are shown in the drawings to be oblong, a single elongated aperture (not shown) capable of accommodating more than one fastener may be provided.

The wall plate 56 extends downwardly from a rear edge 62 of the top plate 50. An opposite or front edge 64 of the top plate 50 has a centrally-located catch 66, extending therefrom. The catch 66 includes a vertical wall 68 and lip 70 at a lowermost end of the vertical wall 68. In order to mount the headrail 14 on the mounting bracket 12, the lip 70 of the catch 66 is securely received in a channel 72 defined in part by the overhanging lip 28 of the shelf 16.

In order to provide clearance between the shelf 16 of the headrail 14 and the head(s) of the fastener(s) (not shown) used to secure the mounting bracket 12 to a ceiling, as well as to provide clearance between the top flat panel portion 48 of the headrail 14, the top plate 50 is preferably provided with sidewalls 74, 76 having a height greater than, or at least equal to, the distance between the top flat panel portion 48 and the shelf 16 of the headrail 14.

The spring clip member 42 of the mounting bracket 12 preferably has an inverted T-shaped body 78, bounded by slits 80, 82 between the inverted T-shaped body 78 and the wall plate 56. The slits 80, 82 preferably extend past the corner 82 at which the wall plate 56 joins the top plate 50, and extend partially along the top plate 50, as shown in FIG. 1. Thus, the spring clip member 42 separates the wall plate 56 into two sections, 56*a*, 56*b*. Alternatively, the slits 80, 82 may terminate at the corner 84. As a further alternate, the slits 80,82 may extend substantially the height of the wall plate 56, but terminate short of the corner 84.

The inverted T-shaped body 78 has at its distal end 86 the hook-like portion 43, which preferably includes an integral extension of the distal end of the inverted T-shaped body 78 which extends at a right angle to the distal end 84, and is folded over itself to form two closely-spaced flanges 88, 90 having a curved spine 92 along one end thereof. Material may be removed from the extension portion of the inverted T-shaped body 78 to form an aperture 94 in the flanges 88, 90. The curved spine 92 provides a smooth surface, which advantageously facilitates hanging the end 40 of the leg 20 of the headrail 14 over the hook-like portion 43 of the mounting bracket 12.

In use, two or more of the mounting brackets 12 are mounted to a wall or ceiling above a window. Next, the headrail 14 (preferably with the elongated member (not shown) from which the valences depend received on the ledges 34, 36) is tilted, with the leg 20 facing the mounting bracket 12, so that the extension 38 is raised. The end 40 of the leg 20 of the headrail 14 is then hanged over the hook-like portion 43 of the mounting bracket 12. Next, the leg 22 of the headrail 14 is raised toward the mounting bracket 12. The resilient spring clip member 42 allows the hook-like portion 43 of the mounting bracket 12 to bend away from the catch 66 extending from the top plate 50 of the mounting bracket 12, until the lip 70 of the catch 66 is securely received in the channel 72 defined in part by the overhanging lip 28 of the shelf 16. When this occurs, an audible snap may be heard.

Figure 4:
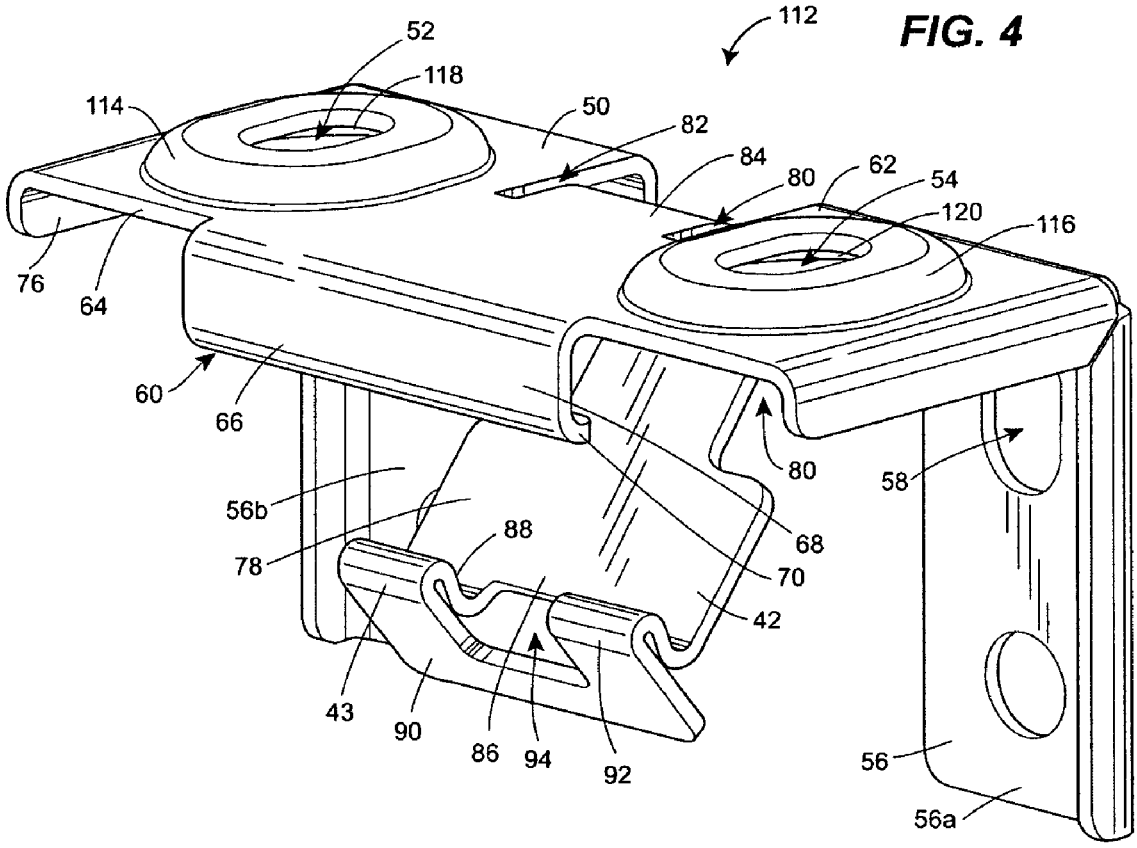
FIG. 4 is a perspective view of another embodiment of a mounting bracket made in accordance with the present invention.

Turning to FIG. 4, a second embodiment of the mounting bracket 112 is shown. In addition to those elements and features that the mounting bracket 112 of the second embodiment has in common with the mounting bracket 12 of the first embodiment, which are indicated in FIG. 4 by the same reference numbers, the mounting bracket 112 has raised sections, 114, 116 in the top plate 50. Each of the raised sections 114, 116 surrounds one of the fastener-receiving apertures 52, 54. Each of the raised sections 114, 116 defines a cavity 118, 120, which cavities advantageously provide greater clearance over the shelf 16 of the head rail 14 in order to accommodate fasteners, such as mounting screws, having a head height greater than the distance between the shelf 16 and the bottom of top plate 50.

While the present invention has been described with respect to a certain preferred embodiment thereof, it will be appreciated by those of ordinary skill in the art that the invention is not limited thereto, and that variations may be made thereto without departing from, and still within the scope of, the appended claims.

We claim:

1. A mounting bracket and headrail assembly comprising:

a mounting bracket having a top plate mountable to a substantially planar surface, the mounting bracket including a catch extending downwardly from a front side of the mounting bracket;

a headrail having first and second legs, the first leg being securably received in the mounting bracket between a spring clip projecting downwardly from a rear side of the mounting bracket and the catch of the mounting bracket, the second leg extending prominently of the catch such that the first leg and the mounting bracket are obscured from view from a direction forward of the assembly; and the headrail including a first ledge extending forwardly from the first leg and a second ledge spaced from the first ledge and extending rearwardly from the second leg, whereby a plurality of valences may be suspended from an elongated member supported by the first and second ledges.

2. The mounting bracket and headrail assembly of claim 1, wherein the headrail further includes a wall member on the second ledge, the wall member extending upward relative to the second ledge, whereby forward movement of an elongated member supported by the first and second ledges is limited.

3. A method of using a mounting bracket and headrail assembly to enable support of an elongated member from which a plurality of window valences may be suspended, comprising:

mounting two or more mounting brackets, each mounting bracket having a mountable top plate with at least one fastener-receiving aperture therein, a catch extending downwardly from a front side of the mounting bracket, and a spring clip extending downwardly from a rear side of the mounting bracket, to a planar surface;

tilting a headrail having a first leg, a second leg, a first ledge projecting forwardly from the first leg, a second ledge spaced from the first ledge and projecting rearwardly from the second leg, with the first leg raised relative to the second leg;

hanging the first leg of the headrail over the spring clip of the mounting bracket; and raising the second leg of the headrail toward the mounting bracket until the first leg of the headrail is securely bounded by the catch and the spring clip.

4. The method of claim 3, the catch of the mounting bracket including a vertical wall and a lip projecting from the vertical wall in a direction toward a rear side of the mounting bracket, and the headrail including a shelf portion from which the first leg depends, and the shelf portion including an overhanging lip defining an undercut, and wherein, in raising the second leg of the headrail toward the mounting bracket until the first leg of the headrail is securely bounded by the catch and the spring clip, the second leg of the headrail is raised until the lip of the catch of the mounting bracket is securely received in a channel defined in the undercut defined by the overhanging lip of the headrail.

* * * * *